US007044573B2

(12) United States Patent
King et al.

(10) Patent No.: US 7,044,573 B2
(45) Date of Patent: May 16, 2006

(54) PRINTHEAD ALIGNMENT TEST PATTERN AND METHOD FOR DETERMINING PRINTHEAD MISALIGNMENT

(75) Inventors: David Golman King, Lexington, KY (US); Patrick Laurence Kroger, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 908 days.

(21) Appl. No.: 10/079,067

(22) Filed: Feb. 20, 2002

(65) Prior Publication Data

US 2003/0156148 A1 Aug. 21, 2003

(51) Int. Cl.
*B41J 29/393* (2006.01)

(52) U.S. Cl. ..... 347/19; 347/14; 347/15

(58) Field of Classification Search ..... 347/19, 347/15, 14; 358/518; 400/709, 709.2
See application file for complete search history.

(56) References Cited

U.S. PATENT DOCUMENTS

| | | | | |
|---|---|---|---|---|
| 4,930,018 | A | 5/1990 | Chan et al. | 358/128 |
| 5,431,724 | A | 7/1995 | Adamic et al. | 106/22 R |
| 5,874,979 | A | 2/1999 | Ohyama | 347/104 |
| 6,033,048 | A | 3/2000 | Nicoloff, Jr. et al. | 347/12 |
| 6,079,888 | A | 6/2000 | Chen et al. | 400/162 |
| 6,089,766 | A | 7/2000 | Yamada et al. | 400/120.09 |
| 6,193,347 | B1 | 2/2001 | Askeland et al. | 347/15 |
| 6,210,055 | B1 | 4/2001 | Chen et al. | 400/625 |
| 6,224,203 | B1 | 5/2001 | Wotton et al. | 347/100 |
| 6,234,602 | B1 | 5/2001 | Soto et al. | 347/19 |
| 6,607,260 | B1 * | 8/2003 | Ikeda | 347/19 |

* cited by examiner

*Primary Examiner*—Hai Pham
*Assistant Examiner*—Lam S. Nguyen
(74) *Attorney, Agent, or Firm*—Thompson Hine, LLP

(57) ABSTRACT

A printhead alignment test pattern has spaced-apart images at least partially aligned along an axis. Each image includes leading and trailing edge portions having respective image-outermost leading and trailing edges spaced apart along the axis and includes an intervening portion located between the leading and trailing edge portions. The leading and trailing edge portions have a higher print density than the intervening portion. A method for determining a printhead misalignment of a printer prints the test pattern, moves a sensor along the axis over the images, obtains data from the sensor, determines the locations along the printhead scan axis of the leading and/or trailing edges of the images using the data, and calculates the printhead misalignment from the determined locations of the leading and/or trailing edges of the images. The test pattern reduces cockling of the print media which improves the accuracy of the method.

19 Claims, 2 Drawing Sheets

PRINTHEAD ALIGNMENT TEST PATTERN AND METHOD FOR DETERMINING PRINTHEAD MISALIGNMENT

TECHNICAL FIELD

The present invention relates generally to printers, and more particularly to a printhead alignment test pattern and to a method for determining a printhead misalignment of a printer.

BACKGROUND OF THE INVENTION

Printers include inkjet printers having one or more printheads used to print on print media. An inkjet printhead typically includes a vertical array of inkjet nozzles. In some designs, the vertical array is a single line array aligned perpendicular to the printhead scan direction or aligned slightly tilted from perpendicular when the nozzles in the line array are fired with a time delay as is known to those skilled in the art. In other designs, the vertical array includes two or more vertical line segments horizontally spaced apart with the nozzles in one vertical line segment fired with a time delay relative to the nozzles in another vertical line segment as can be appreciated by the artisan. In still other designs, the vertical array includes two or more horizontally spaced-apart vertical lines or line segments, wherein a nozzle of one vertical line or line segment is positioned vertically between two adjacent nozzles of another vertical line or line segment. The term "printhead" means a group of pixel printing elements capable of causing any possible character or symbol (including a single or multi-pixel character or symbol) of a single color to be printed on the print media. The term "printhead" also includes the terms "pen" and "cartridge". A typical color inkjet printer has a black printhead and three color printheads (such as a cyan printhead, a yellow printhead, and a magenta printhead). In some designs, the three color printheads are three groups of nozzles on a single printhead block mounted to the printhead carriage. Printers having horizontally spaced-apart redundant printheads are known.

Print quality depends on the skew alignment of each printhead with respect to the printhead scan direction, on the bi-directional alignment of each printhead in the forward printhead scan direction relative to the reverse printhead scan direction, and on the horizontal and vertical alignments of one printhead relative to another printhead. A conventional method of printhead alignment includes printing a printhead alignment test pattern (having spaced-apart images) on the print media, passing a printhead-carriage-mounted optical sensor along the printhead scan direction over the alignment pattern to detect the alignment pattern, using a counter-timer to measure the time it takes the optical sensor to reach the leading and/or trailing edges of the images of the alignment pattern, calculating the positions of the images from the measured times of the counter timer, and determining the printhead misalignments from the calculated image positions. The spaced-apart images are identical blocks printed at a 100% print density for better determination of the edges of the images by the sensor.

Print quality during printing also depends on reducing paper cockle which is the wavy appearance of the print media paper due to exposure to moisture from the ink deposited thereon by the printhead during printing. It is known to reduce paper cockle by printing a page wherein each print object (such as, but not limited to, a text character or a symbol) is printed at a same print density (sometimes also called a gray scale regardless of ink color) less than 100%.

What is needed is an improved method for determining a printhead misalignment of a printer and an improved printhead alignment test pattern.

SUMMARY OF THE INVENTION

A first method of the invention is for determining a printhead misalignment of a printer and includes steps a) through e). Step a) includes printing a printhead alignment test pattern including spaced-apart images at least partially aligned substantially along a printhead scan axis. Each image includes leading and trailing edge portions having respective image-outermost leading and trailing edges spaced apart along the printhead scan axis and includes an intervening portion located between the leading and trailing edge portions. The leading and trailing edge portions are printed at a higher print density than the intervening portion. Step b) includes moving a sensor along the printhead scan axis over the images. Step c) includes obtaining data from the sensor. Step d) includes determining the locations along the printhead scan axis of the leading and/or trailing edges of the images using the data. Step e) includes calculating the printhead misalignment from the determined locations of the leading and/or trailing edges of the images.

A first embodiment of the invention is for a printhead alignment test pattern including printhead-alignment-test-pattern spaced-apart printed images at least partially aligned substantially along an axis. Each image includes leading and trailing edge portions having respective image-outermost leading and trailing edges spaced apart along the axis and includes an intervening portion located between the leading and trailing edge portions. The leading and trailing edge portions have a higher print density than the intervening portion.

Several benefits and advantages are derived from one or more of the method and the embodiment of the invention. Applicants discovered that having a higher print density at the edge portions of the spaced apart images of the printhead alignment test pattern provides more accurate determination of the edges of the images by the sensor by providing a sharp change in sensor output at the edges. Applicants also discovered that having a lower print density for the intervening portion of the images reduced image cockle providing more accurate determination of the edges of the images by providing the sensor with a flat image instead of a cockled image provided to the sensor when a high print density is used for such intervening portion. Applicants image has a shorter ink drying time than a conventional image so there is less chance of a misleading sensor reading due to a highly-reflective wet-ink image being presented to the sensor.

DETAILED DESCRIPTION

Figure 1:
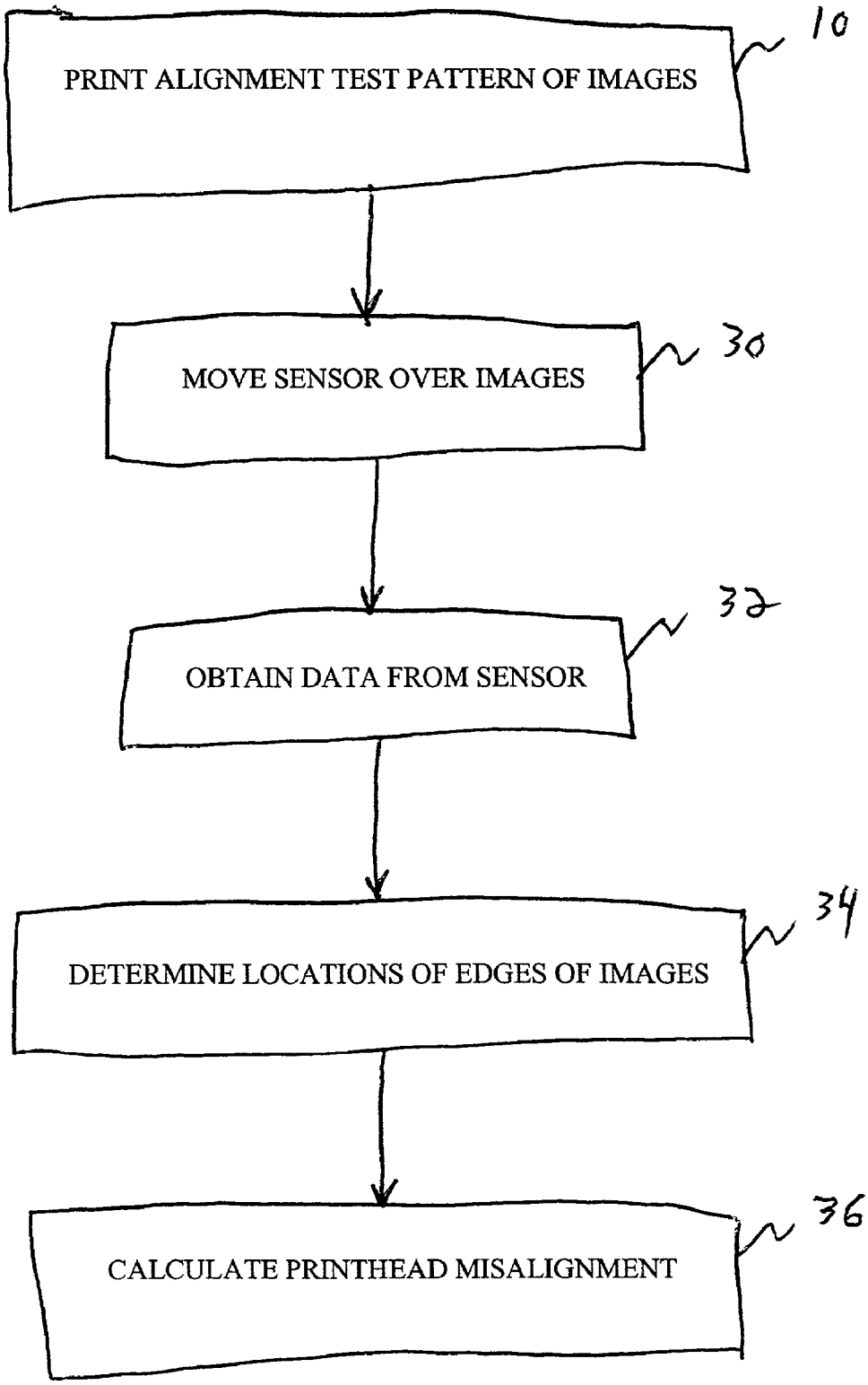
FIG. 1 is a flow chart of a first method of the invention.
Figure 3:
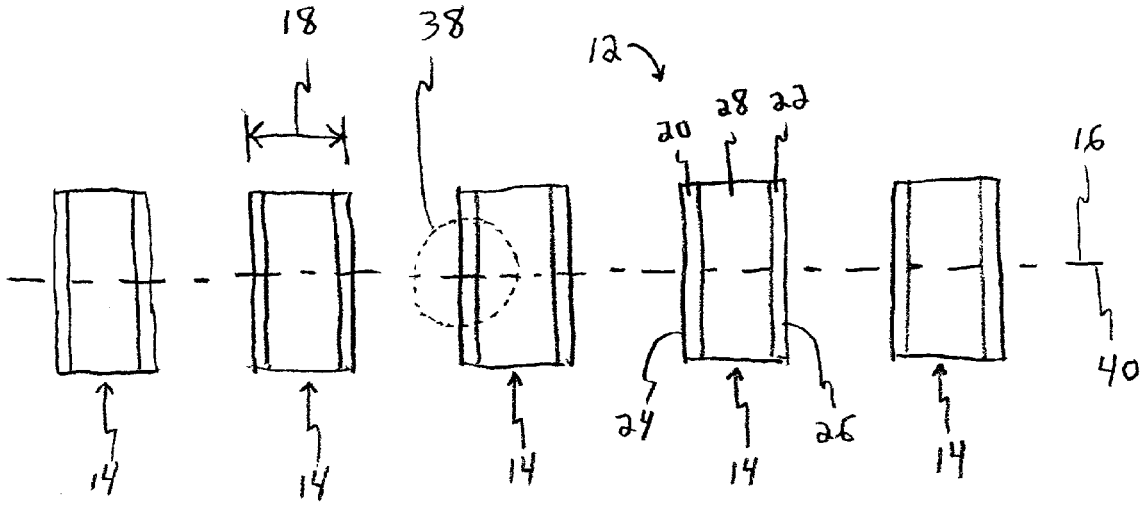
FIG. 3 is a view, as in FIG. 2, but with the addition of a printhead scan axis and with the addition of an example of the sensed region (which shows a sensed spot size) on one of the printed images of the printhead alignment test pattern which is sensed by the moving sensor in the first method of FIG. 1.
Figure 2:
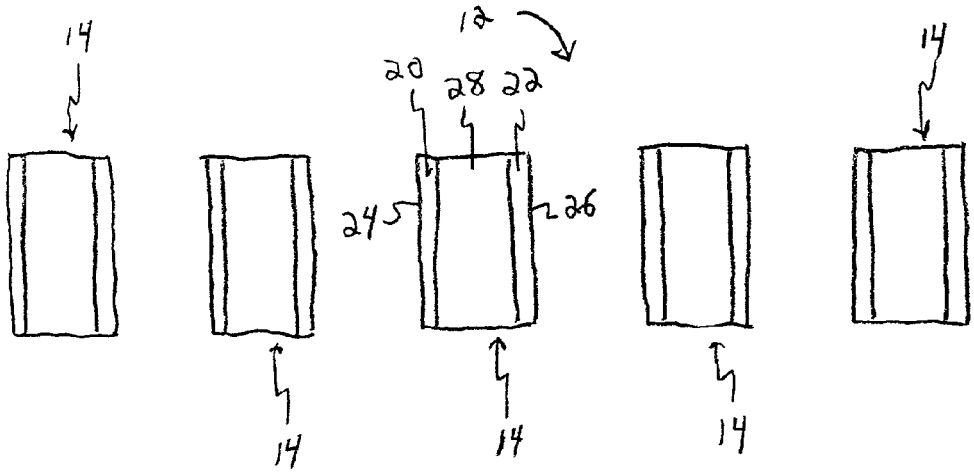
FIG. 2 is a schematic diagram of a first embodiment of a printhead alignment test pattern of the invention and is a non-limiting example of a printhead alignment test pattern printed by the first method of FIG. 1.

A first method of the invention is for determining a printhead misalignment of a printer and is shown in flow chart form in FIG. 1. Examples of printhead misalignment include, without limitation, skew misalignment of a printhead with respect to the printhead scan direction, bi-directional misalignment of a printhead in a forward printhead scan direction relative to the reverse printhead scan direction, horizontal misalignment of one printhead relative to another printhead, and vertical misalignment of one printhead relative to another printhead. The method includes steps a) through e). Step a) is labeled as "Print Alignment Test Pattern Of Images" in block 10 of FIG. 1. It is noted that a first embodiment of a printhead alignment test pattern 12 of the invention is shown schematically in FIGS. 2 and 3 and that printhead alignment test pattern 12 is a non-limiting example of a printhead alignment test pattern printed by step a). Step a) includes printing a printhead alignment test pattern 12 including a plurality of spaced-apart images 14 at least partially aligned substantially along a printhead scan axis 16, wherein each image 14 includes leading and trailing edge portions 20 and 22 having respective image-outermost leading and trailing edges 24 and 26 spaced apart along the printhead scan axis 16 and includes an intervening portion 28 disposed between the leading and trailing edge portions 20 and 22, and wherein the leading and trailing edge portions 20 and 22 are printed at a higher print density than the intervening portion 28. Thus, the leading edge portion 20 of each image 14 has the image-outermost leading edge 24, and the trailing edge portion 22 of each image 14 has the image-outermost trailing edge 26, as shown in FIGS. 2 and 3. The images 14 can have any shape and be of any size. In one example, the images 14 are substantially identical images. It is noted that the leading and trailing edge portions 20 and 22 and the intervening portion 28 of each image 14 in FIGS. 2 and 3 have been left blank for purposes of clarity instead of being filled at print densities as hereinbefore and hereinafter described.

Step b) of the first method is labeled as "Move Sensor Over Images" in block 30 of FIG. 1. Step b) includes moving a sensor (not shown) along the printhead scan axis 16 over the plurality of images 14. It is noted that the moving sensor first passes over the leading edge 24 and then passes over the trailing edge 26 of each image 14. Step c) is labeled as "Obtain Data From Sensor" in block 32 of FIG. 1. Step c) includes obtaining data from the sensor. Step d) is labeled as "Determine Locations Of Edges Of Images" in block 34 of FIG. 1. Step d) includes determining the locations along the printhead scan axis 16 of the leading and/or trailing edges 24 and 26 of the plurality of images 14 using the data. Step e) of the first method is labeled as "Calculate Printhead Misalignment" in block 36 of FIG. 1. Step e) includes calculating the printhead misalignment from the determined locations of the leading and/or trailing edges 24 and 26 of the plurality of images 14. Steps b) through e) are conventional steps of conventional printhead auto-alignment methods (which are based on the known speed of the moving sensor and the times the sensor detects the leading and/or trailing edges of each image) wherein each image of the conventional printhead alignment test pattern is printed at a print density of 100%. Such conventional steps are well known to the artisan and can be used with the printhead alignment test pattern 12 printed by step a) of the first method of the invention. U.S. patent application Ser. No. 09/972,101 by Cunnagin et al. entitled "Method For Determining Printhead Misalignment Of A Printer" and filed Oct. 5, 2001 is herein incorporated by reference.

In one variation of the first method, in step d) the locations of only the leading or trailing edges 24 or 26 of the images 14 are determined and in step e) used to calculate printhead misalignment as can be appreciated by those skilled in the art. In another variation, in step d) the locations of both the leading and trailing edges 24 and 26 of the images are determined and in step e) used to calculate printhead misalignment. In a further variation, in step d) the locations of the leading (or trailing) edge of a first image is determined and the locations of the trailing (or leading) edge of the second image is determined and in step e) used to calculate printhead misalignment. Other variations in selecting leading and/or trailing edges 24 and/or 26 of images 14 for determination in step d) and use in step e) are left to the artisan. In one implementation, step e) includes calculating the locations of the centers of the images from the edge locations of step d) and calculating the printhead misalignment from the center locations as can be done by those skilled in the art. Other implementations for calculating the printhead misalignment in step e) from the edge locations of step d) are left to the artisan.

As previously mentioned, the term "printhead" means a group of pixel printing elements capable of causing any possible character or symbol (including a single or multi-pixel character or symbol) of a single color to be printed on the print media. The term "printhead" also includes the terms "pen" and "cartridge". Printers having printheads include, without limitation, inkjet printers. A typical color inkjet printer has a black printhead and three color printheads (such as a cyan printhead, a yellow printhead, and a magenta printhead). In some designs, the three color printheads are three groups of nozzles on a single printhead block mounted to the printhead carriage. It is noted that some printers have horizontally spaced-apart redundant printheads.

Applicants discovered that the sensor output (such as the voltage output of a conventional optical sensor having an LED emitter and a phototransistor receiver) varies with unwanted variations in the distance and in the angle between the sensor and the print media (such as paper) on which the images 14 are printed. Such unwanted distance and/or angle variations can lead to inaccuracies in determining the edge locations of the images 14. Inaccuracies in edge determination leads to inaccuracies in calculating the printhead misalignment. Inaccuracies in printhead misalignment calculations leads to inaccurate corrections for printhead misalignment and thus poor print quality. Applicants discovered that paper cockle (i.e., the wavy appearance of paper exposed to moisture such from the ink of the images 14) contributed to such unwanted distance and angle variations. Other types of print media also are subject to cockling. Applicants also discovered that such distance and angle variations can be reduced by printing the images 14 in accordance with the previously-described step a) of the first method of the invention. It is noted that the type of sensor is left to the artisan. It also is noted that Applicants image has a shorter ink drying time than a conventional image so there is less chance of a misleading sensor reading due to a highly-reflective wet-ink image being presented to the sensor.

In one example of the first method of the invention, the leading and trailing edge portions 20 and 22 of one of the images 14 (and in one application, each of the images 14) are printed at a substantially uniform and substantially identical print density. In one modification, the intervening portion 28 of the one image 14 (and in one application, each of the images 14) is printed at a substantially uniform print density. In one variation, the intervening portion 28 of the one image 14 (and in one application, each of the images 14) is printed to extend along the printhead scan axis 16 to the leading and trailing edge portions 20 and 22. Illustrations of a non-uniform-print-density image and of non-identical images are left to the artisan.

In the same or a different example, step a) of the first method prints each of the leading and trailing edge portions 20 and 22 of one (or each) of the images 14 at a print density in the range of substantially 75% to substantially 100% and prints the intervening portion 28 of the one (or each) image 14 at a print density in the range of substantially 25% to substantially 50%. It is noted that a print density of say 75% is also known as a 75% gray scale regardless of the color or colors of the ink of the image 14. Print densities less than substantially 75% for the leading and trailing edge portions 20 and 22 tend to decrease the accuracy of determining printhead misalignment by not providing a sharp change in sensor output at the image-outermost leading and trailing edges 24 and 26. Print densities less than substantially 25% for the intervening portion 28 tend to cause the sensor output to be interpreted as a false edge, and print densities greater than substantially 50% tend to decrease the accuracy of determining printhead misalignment because of paper cockling. In one modification, step a) prints each of the leading and trailing edge portions 20 and 22 of the one (or each) image 14 at a print density of substantially 100% and prints the intervening portion 28 of the one (or each) image 14 at a print density of substantially 50%. These print density ranges and values apply best for optically sensing black ink on paper. Other print density ranges would apply for different colored inks, for different print media, and for different types of sensors, as can be appreciated by the artisan.

In the same or a different example of the first method, each image 14 has a width (indicated by double-headed arrow 18) measured along the printhead scan axis 16, and step a) prints one (or each) of the images 14 with the leading and trailing edge portions 20 and 22 thereof each extending in the range of substantially 5% to substantially 20% of the width 18 of the one (or each) image 14 measured along the printhead scan axis 16. Edge-portion width ranges less than substantially 5% tend to decrease the accuracy of determining printhead misalignment by not providing a sharp change in sensor output at the image-outermost leading and trailing edges 24 and 26. Edge-portion width ranges greater than substantially 20% tend to decrease the accuracy of determining printhead misalignment because of paper cockling. In one modification, step a) prints the one (or each) image 14 with the leading and trailing edge portions 20 and 22 thereof each extending substantially 10% of the width 18 of the one (or each) image 14 measured along the printhead scan axis 16.

In the same or a different example of the first method, the sensor is disposed to sense a spot size 38 (shown as a circle in the example of FIG. 3) on each of the images 14. It is noted that the spot moves across the image 14 as the sensor moves across the image 14. In this example, step a) prints each image 14 with the leading and trailing edge portions 20 and 22 thereof each extending in the range of substantially 10% to substantially 50% of the extent of the spot size 38 measured along the printhead scan axis 16. Other shapes of spot sizes for sensors are left to the artisan.

In one implementation of the first method, the images 14 are substantially identical block images of black ink on paper. In this implementation, the images 14 are rectangles when determining the skew misalignment of each printhead with respect to the printhead scan direction, the bi-directional misalignment of each printhead in the forward printhead scan direction relative to the reverse printhead scan direction, or the horizontal misalignment of one printhead relative to another printhead. The rectangles are aligned with the leading and trailing edges perpendicular to the printhead scan axis. Each rectangle has a width along the printhead scan axis of $^{48}/_{600}$-inch and has a height of $^{1}/_{10}$ inch. In this implementation, the sensor is an optical sensor (having an LED emitter and a phototransistor detector) whose optical axes converge at a distance of 3.5 millimeters from the sensor. The sensor is disposed 3.5 millimeters from the paper containing the images. From the image-outermost leading and trailing edge data, the center point of each block is calculated. In alignment, the blocks will be equidistant. Misalignment causes the blocks to shift relative to one another. The sensor detects the shift from which there is generated a misalignment correction factor. In this implementation, to determine vertical misalignment of one printhead relative to another printhead, the image blocks are rhomboid-shaped blocks (not shown) wherein the leading and trailing edges of each block are oriented at substantially 30 degrees from the printhead scan axis and wherein the previously-calculated horizontal misalignment is also used, as is understood by those skilled in the art.

A first embodiment of the invention is for a printhead alignment test pattern 12 including a plurality of printhead-alignment-test-pattern spaced-apart printed images 14. The images 14 are at least partially aligned substantially along an axis 40 (such as the printhead scan axis 16). Each image 14 includes leading and trailing edge portions 20 and 22 having respective image-outermost leading and trailing edges 24 and 26 spaced apart along the axis 40 and includes an intervening portion 28 disposed between the leading and trailing edge portions 20 and 22. The leading and trailing edge portions 20 and 22 have a higher print density than the intervening portion 28. All of the examples, modifications, variations, applications, implementations, etc. of the printhead alignment test pattern 12 previously described with reference to the first method of the invention are equally applicable to the printhead alignment test pattern 12 above described for the first embodiment of the invention.

Odd numbered images 14 along the axis 40 are printed with an upper portion of a printhead and even numbered images 14 along the axis 40 are printed with a lower portion of that printhead when the printhead alignment test pattern 12 is used in one example of determining the skew misalignment of each printhead with respect to the printhead scan direction. Odd numbered images 14 along the axis 40 are printed with the printhead moving from left to right and even numbered images 14 along the axis 40 are printed with the printhead moving from right to left in one example of determining the bi-directional misalignment of each printhead in the forward printhead scan direction relative to the reverse printhead scan direction. Odd numbered images 14 along the axis 40 are printed with a first printhead and even numbered images 14 along the axis 40 are printed with a second printhead in one example of determining the horizontal or vertical misalignments of one printhead relative to another printhead. Other examples of printhead and image associations for these or other examples of printhead misalignment determinations are left to the artisan.

Several benefits and advantages are derived from one or more of the method and the embodiment of the invention. Applicants discovered that having a higher print density at the edge portions of the spaced apart images of the printhead alignment test pattern provides more accurate determination of the edges of the images by the sensor by providing a sharp change in sensor output at the edges. Applicants also discovered that having a lower print density for the intervening portion of the images reduced image cockle providing more accurate determination of the edges of the images by providing the sensor with a flat image instead of a cockled image provided to the sensor when a high print density is used for such intervening portion. Applicants image has a shorter ink drying time than a conventional image so there is less chance of a misleading sensor reading due to a highly-reflective wet-ink image being presented to the sensor.

The foregoing description of a first method and a first embodiment of the invention has been presented for purposes of illustration. It is not intended to be exhaustive or to limit the invention to the precise method or form disclosed, and obviously many modifications and variations are possible in light of the above teaching. It is intended that the scope of the invention be defined by the claims appended hereto.

What is claimed is:

1. A method for determining a printhead misalignment of a printer comprising the steps of:

a) printing a printhead alignment test pattern including a plurality of spaced-apart images at least partially aligned substantially along a printhead scan axis, wherein each image includes leading and trailing edge portions having respective image-outermost leading and trailing edges spaced apart along the printhead scan axis and includes an intervening portion disposed between the leading and trailing edge portions, and wherein the leading and trailing edge portions are printed at a higher print density than the intervening portion;

b) moving a sensor along the printhead scan axis over the plurality of images;

c) obtaining data from the sensor;

d) determining the locations along the printhead scan axis of at least one of the leading and trailing edges of the plurality of images using the data; and e) calculating the printhead misalignment from the determined locations of the at least one of the leading and trailing edges of the plurality of images.

2. The method of claim 1, wherein the leading and trailing edge portions of one of the images are printed at a substantially uniform and substantially identical print density.

3. The method of claim 2, wherein the intervening portion of the one image is printed at a substantially uniform print density.

4. The method of claim 3, wherein the intervening portion of the one image is printed to extend along the printhead scan axis to the leading and trailing edge portions.

5. The method of claim 1, wherein step a) prints each of the leading and trailing edge portions of one of the images at a print density in the range of substantially 75% to substantially 100% and prints the intervening portion of the one image at a print density in the range of substantially 25% to substantially 50%.

6. The method of claim 5, wherein step a) prints each of the leading and trailing edge portions of the one image at a print density of substantially 100% and prints the intervening portion of the one image at a print density of substantially 50%.

7. The method of claim 1, wherein each image has a width measured along the printhead scan axis, and wherein step a) prints one of the images with the leading and trailing edge portions thereof each extending in the range of substantially 5% to substantially 20% of the width of the one image measured along the printhead scan axis.

8. The method of claim 7, wherein step a) prints the one image with the leading and trailing edge portions thereof each extending substantially 10% of the width of the one image measured along the printhead scan axis.

9. The method of claim 1, wherein the sensor is disposed to sense a spot size on each of the images, and wherein step a) prints each image with the leading and trailing edge portions thereof each extending in the range of substantially 10% to substantially 50% of the extent of the spot size measured along the printhead scan axis.

10. A method for determining a printhead misalignment of a printer comprising the steps of:

a) printing a printhead alignment test pattern including a plurality of spaced-apart images at least partially aligned substantially along a printhead scan axis, wherein each image includes leading and trailing edge portions having respective image-outermost leading and trailing edges spaced apart along the printhead scan axis and includes an intervening portion disposed between the leading and trailing edge portions, and wherein the leading and trailing edge portions are printed at a higher print density than the intervening portion;

b) moving a sensor along the printhead scan axis over the plurality of images;

c) obtaining data from the sensor;

d) determining the locations along the printhead scan axis of at least one of the leading and trailing edges of the plurality of images using the data; and e) calculating the printhead misalignment from the determined locations of the at least one of the leading and trailing edges of the plurality of images, wherein the leading and trailing edge portions of each image are printed at a substantially uniform and substantially identical print density, wherein the intervening portion of each of the images is printed at a substantially uniform print density, wherein the intervening portion of each of the images is printed to extend along the printhead scan axis to the leading and trailing edge portions, and wherein step a) prints each of the leading and trailing edge portions of each of the images at a print density in the range of substantially 75% to substantially 100% and prints the intervening portion of each of the images at a print density in the range of substantially 25% to substantially 50%.

11. A printhead alignment test pattern comprising a plurality of printhead-alignment-test-pattern spaced-apart printed images at least partially aligned substantially along an axis, wherein each image includes leading and trailing edge portions having respective image-outermost leading and trailing edges spaced apart along the axis and includes an intervening portion disposed between the leading and trailing edge portions, wherein the leading and trailing edge portions have a higher print density than the intervening portion, and wherein each of the leading and trailing edge portions of one of the images has a print density in the range of substantially 75% to substantially 100% and the intervening portion of the one image has a print density in the range of substantially 25% to substantially 50%.

12. The printhead alignment test pattern of claim 11, wherein the leading and trailing edge portions of one of the images have a substantially uniform and substantially identical print density.

13. The printhead alignment test pattern of claim 12, wherein the intervening portion of the one image has a substantially uniform print density.

14. The printhead alignment test pattern of claim 13, wherein the intervening portion of the one image extends along the axis to the leading and trailing edge portions.

15. The printhead alignment test pattern of claim 11, wherein each of the leading and trailing edge portions of the one image has a print density of substantially 100% and the intervening portion of the one image has a print density of substantially 50%.

16. The printhead alignment test pattern of claim 11, wherein each image has a width measured along the axis, and wherein each of the leading and trailing edge portions of one of the images extends in the range of substantially 5% to substantially 20% of the width of the one image measured along the axis.

17. The printhead alignment test pattern of claim 16, wherein each of the leading and trailing edge portions of the one image extends substantially 10% of the width of the one image measured along the axis.

18. The printhead alignment test pattern of claim 11, wherein the images are substantially identical block images.

19. A printhead alignment test pattern comprising a plurality of spaced-apart printed images at least partially aligned substantially along an axis, wherein each image includes leading and trailing edge portions having respective image-outermost leading and trailing edges spaced apart along the axis and includes an intervening portion disposed between the leading and trailing edge portions, and wherein the leading and trailing edge portions have a higher print density than the intervening portion, wherein the leading and trailing edge portions of each of the images have a substantially uniform and substantially identical print density, wherein the intervening portion of each of the images has a substantially uniform print density, wherein the intervening portion of each of the images extends along the axis to the leading and trailing edge portions, wherein each of the leading and trailing edge portions of each of the images has a print density in the range of substantially 75% to substantially 100% and the intervening portion of each of the images has a print density in the range of substantially 25% to substantially 50%, and wherein the images are substantially identical block images.

* * * * *